US006096986A

United States Patent [19]

Flegel

[11] Patent Number: 6,096,986

[45] Date of Patent: Aug. 1, 2000

[54] CHANNEL-TYPE CIRCUIT BREAKER SWITCH INTERLOCK

[75] Inventor: David D. Flegel, Racine, Wis.

[73] Assignee: Reliance Controls Corporation, Racine, Wis.

[21] Appl. No.: 09/391,582

[22] Filed: Sep. 8, 1999

[51] Int. Cl.[7] ..... H01H 9/20

[52] U.S. Cl. ..... 200/50.33; 200/43.16

[58] Field of Search ..... 200/50.33, 5 EA, 200/50.32, 50.35, 43.16

[56] References Cited

U.S. PATENT DOCUMENTS

| | | |
|---|---|---|
| 3,158,701 | 11/1964 | Nadeau . |
| 3,198,898 | 8/1965 | Piteo, Jr. . |
| 3,647,997 | 3/1972 | Nerem . |
| 3,705,280 | 12/1972 | Harms . |
| 3,778,633 | 12/1973 | DeVisser et al. . |
| 4,270,031 | 5/1981 | Borona et al. . |
| 4,510,357 | 4/1985 | Winterbottom . |
| 4,665,284 | 5/1987 | Guinan . |
| 4,902,859 | 2/1990 | Witzmann et al. . |
| 4,906,958 | 3/1990 | Adamson . |
| 4,924,041 | 5/1990 | Yee . |
| 4,980,525 | 12/1990 | Kasisako . |
| 5,008,499 | 4/1991 | Yee et al. . |
| 5,109,142 | 4/1992 | VonKannewurff et al. . |
| 5,122,624 | 6/1992 | Benda . |
| 5,172,087 | 12/1992 | Castonguay et al. . |
| 5,189,385 | 2/1993 | Gnahn . |
| 5,268,543 | 12/1993 | Ramos . |
| 5,270,503 | 12/1993 | Frye . |
| 5,310,969 | 5/1994 | Turek et al. . |
| 5,322,980 | 6/1994 | Benda . |
| 5,648,646 | 7/1997 | Flegel . |

*Primary Examiner*—Michael L. Gellner
*Assistant Examiner*—Nhung Nguyen
*Attorney, Agent, or Firm*—Andrus, Sceales, Starke & Sawall

[57] ABSTRACT

An interlock for aligned switch members, which are movable toward each other to an ON position and away from each other to an OFF position, includes a pair of engagement members and a connector member extending therebetween. Each engagement member includes a planar retainer section which extends outwardly and is adapted for receipt within a passage defined by the switch member, for guiding axial movement of the engagement members relative to the switch members. Each engagement member further includes a pair of upstanding tabs, and the engagement members are positioned such that the tabs are located adjacent each other between the switches. The connector member includes an upper wall located above the plane of the retainer sections, and depending side walls which are interconnected with the tabs via screws which pass through openings in the tabs and into aligned, threaded openings in the depending side walls. The interlock is simple in its components and installation, and provides a strong, positive interlock structure which can be used in either an original installation or in a retrofit application.

20 Claims, 4 Drawing Sheets

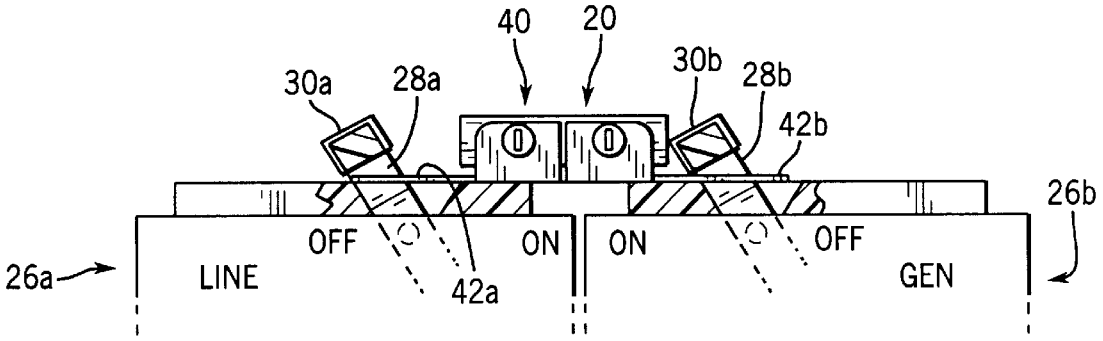
FIG. 6
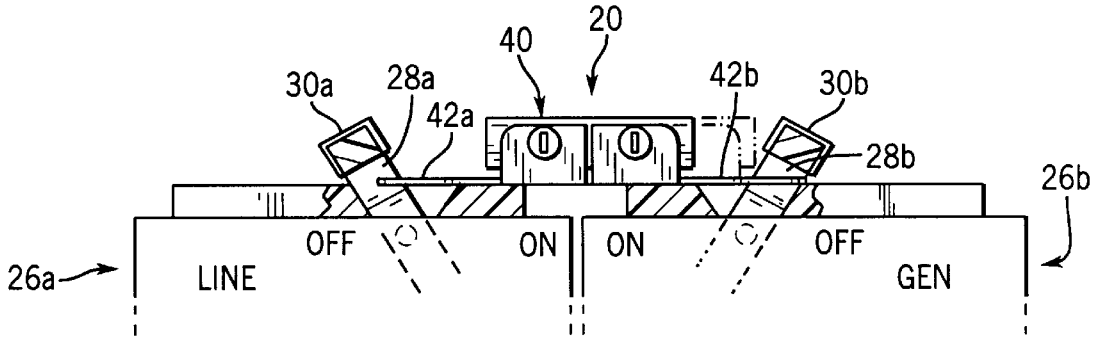
FIG. 7
FIG. 8
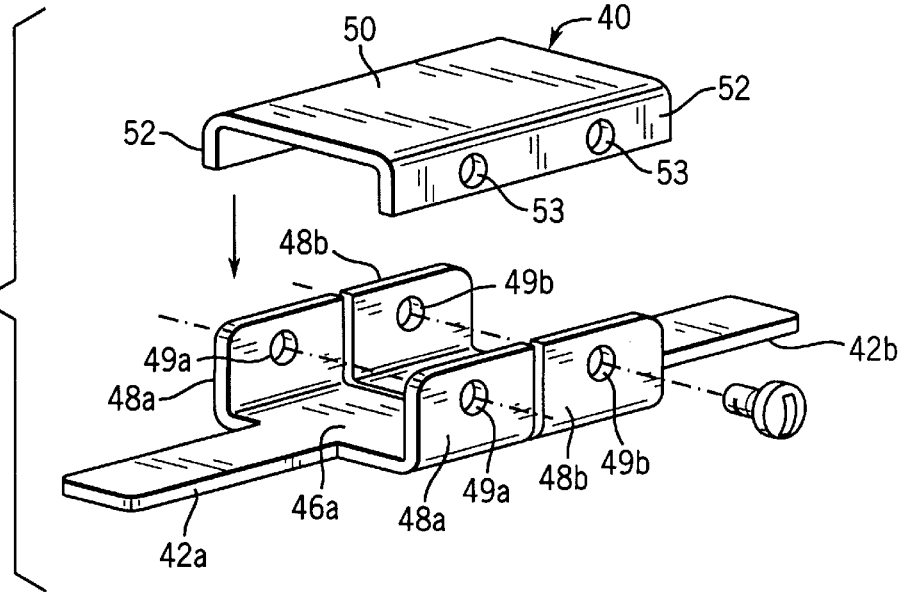

CHANNEL-TYPE CIRCUIT BREAKER SWITCH INTERLOCK

FIELD OF THE INVENTION

This invention is generally related to an interlock for circuit breaker switches and, more particularly, pertains to a circuit breaker switch interlock for placement between two opposed circuit breaker handles for preventing both circuit breakers from being in an ON position at the same time.

BACKGROUND OF THE INVENTION

In an electrical supply system, there are occasions when an alternate source of electric power is necessary or desirable. For example, the capability of switching from utility power to emergency generator power is important for businesses, hospitals and industries, and is also being employed in residential applications.

In certain applications, it is desirable for separate electrical circuits or even separate groups of electrical circuits to be arranged so that when one group of circuits is switched to a conductive state, another group of circuits is switched to a non-conductive state so as to prevent power supply to the circuits from two different power sources at the same time, e.g. from both a utility power supply and a generator power supply. In an arrangement such as this, a switch is typically provided for each power source to control the supply of electrical power. Accordingly, it is important to ensure that the switches are prevented from both being in the ON position at the same time, to ensure that power is supplied to the switch from only one power source.

Interlocks have been devised for preventing adjacent, aligned switches from both being in an ON position at the same time, to ensure that power is not supplied simultaneously from two different sources. Examples of such interlocks are disclosed in Flegel U.S. Pat. No. 5,648,646 issued Jul. 15, 1997, and in co-pending application Ser. No. 09/232,898, filed Jan. 15, 1999. The '646 patent discloses an interlock utilizing a linkage arrangement interconnected with opposite ends defined by each operating handle. The linkage applies a linear force between the operating handles when the handles are moved toward each other, to prevent the handles from simultaneously being in the ON position. This arrangement operates satisfactorily, but entails a number of components and requires interconnection with the switch handles. This can be a drawback, in that all switch handles may not have structure which facilitates connection with the ends of the switch handle, and prevents the same interlock from being used with switch handles of varying length.

The interlock disclosed in the '898 application utilizes a pair of base strips, each of which is engageable within a passage typically defined by the operating handle. The inner ends of the base strips are located adjacent each other between the handles, and a connector member is secured to the inner ends of the base strips to interconnect the base strips together. The connector member includes upstanding end portions, each of which faces one of the operating handles. The connector member end portions are configured so as to engage the handles and prevent both handles from being moved toward each other to the ON position at the same time. A screw or other guide member is mounted to the outer end of each base strip, and is adapted for receipt within a slot defined by the switch for guiding axial movement of the interconnected strips and connector member relative to the switches and operating handles. This construction is not physically interconnected with the handles and thus can be used with handles of varying widths so long as each handle defines a passage for receiving one of the strips.

It is an object of the present invention to provide a simplified interlock arrangement for a pair of aligned switches. It is a further object of the invention to provide such an interlock arrangement which relies upon a passage defined by each handle for mounting the interlock between the handles and for guiding axial movement of the interlock relative to the handles. Yet another object of the invention is to provide such an interlock arrangement which includes a more substantial interlock structure located between the operating handles as compared to the previous strip-type construction. Yet another object of the invention is to provide such an interlock arrangement which does not rely upon engagement within a slot defined by the switch for guiding movement of the interlock relative to the handles. A still further object of the invention is to provide such an interlock arrangement which is relatively simple in its components, construction and installation, yet which provides highly satisfactory operation in preventing adjacent, aligned switches from both being in an ON position at the same time.

SUMMARY OF THE INVENTION

The present invention advantageously provides an improved interlock for switches installed in a load center or other electrical panel, for providing a simple and safe arrangement for ensuring that power is supplied from a single power source. The interlock of the invention enables use of standard, off-the-shelf switches, and can be assembled with the switches or can be retrofitted without modification of the switch and without fastening of the interlock to the switch and without the need for special assembly tools.

In accordance with the invention, an interlock for first and second aligned switches includes a pair of engagement members and a connector member. Each switch includes an operating handle defining a passage and is movable toward the other handle to an ON position and away from the other handle to an OFF position. The interlock is disposed between the handles for preventing both switches from being in the ON position at the same time. Each engagement member includes an axially extending retainer section adapted to be received within one of the operating handle passages, and an upstanding inner connection section located between the handles when the retainer section is received within one of the operating handle passages. The inner connection sections are adapted for placement adjacent each other, and each defines a planar base section engageable with an outer surface of the switch, and a pair of upstanding tabs extending from opposite ends defined by the planar base section. The connector member extends between and is interconnected with the tabs. The interconnected tabs and connector member cooperate to define an interlock structure movably retained between the operating handles and configured so as to prevent both operating handles from being in the ON position at the same time. The connector member defines an outer wall located between the pair of tabs, and a pair of depending side walls arranged such that each side wall spans between and interconnects the upstanding tabs on one side of the engagement members. The tabs and connector member side walls preferably include openings which are alignable with each other and are adapted to receive fasteners for securing the connector member to the engagement members.

The axially extending retainer section of each engagement member is adapted for placement against the outwardly facing surface of one of the switches. The retainer sections cooperate with the handle passages to guide axial movement of the interlock relative to the handles, without guiding engagement with the outwardly facing surfaces of the switches. This provides an interlock which requires a minimum number of parts and is extremely simple in its assembly to the switches.

The invention further contemplates a method of preventing aligned operating handles of a pair of switches from both being in an ON position at the same time, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 6 is a view similar to FIG. 5, showing movement of the other handle to the ON position;

FIG. 7 is a view similar to FIGS. 4–6, showing movement of the interlock between the switch handles and both handles in the OFF position;

FIG. 8 is an exploded isometric view of the interlock of FIG. 3; and

DETAILED DESCRIPTION OF THE INVENTION

Figure 1:
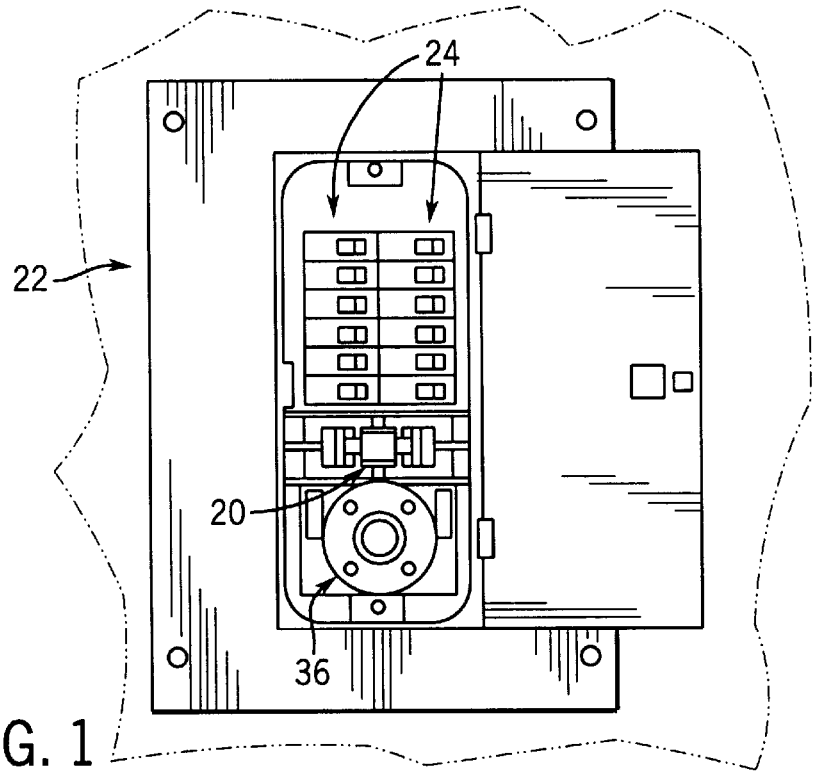
FIG. 1 is a front elevational view of a load center panel having an array of opposed circuit breaker switches and a pair of aligned power supply control switches interconnected by the interlock of the present invention.
Figure 2:
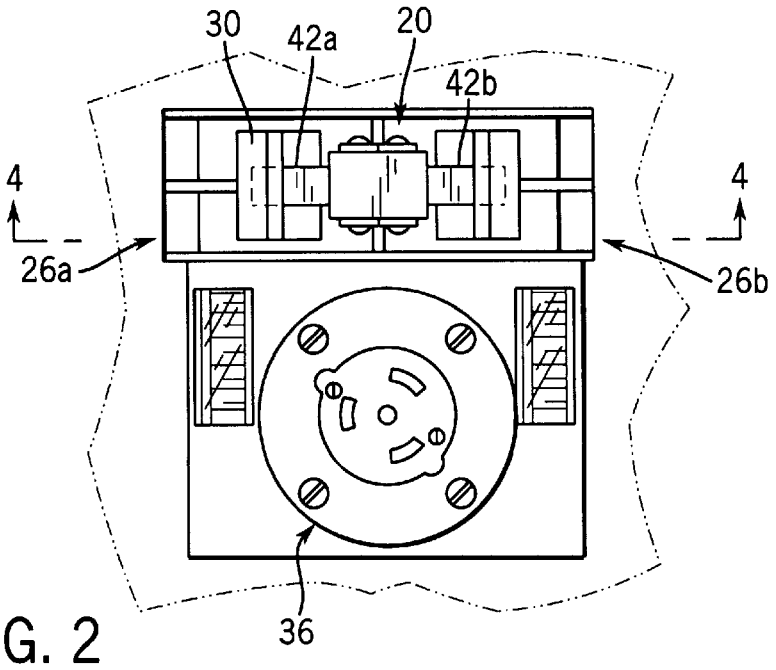
FIG. 2 is an enlarged front elevational view of the aligned power supply switches and the interlock of the present invention, as incorporated into the load center panel of FIG. 1.

Referring to FIGS. 1 and 2, an interlock 20 constructed in accordance with the present invention is shown in connection with an electrical load center 22. In a manner as is known, load center 22 includes a series of circuit breaker switches 24, which may be switches such as are available from the Cutler Hammer Division of Eaton Corp. under the designation Type CH, Double Pole. Circuit breaker switches 24 are conventionally snapped into load center 22, and each set of circuit breakers 24 controls the supply of electrical power to a circuit interconnected with load center 22.

Figure 3:
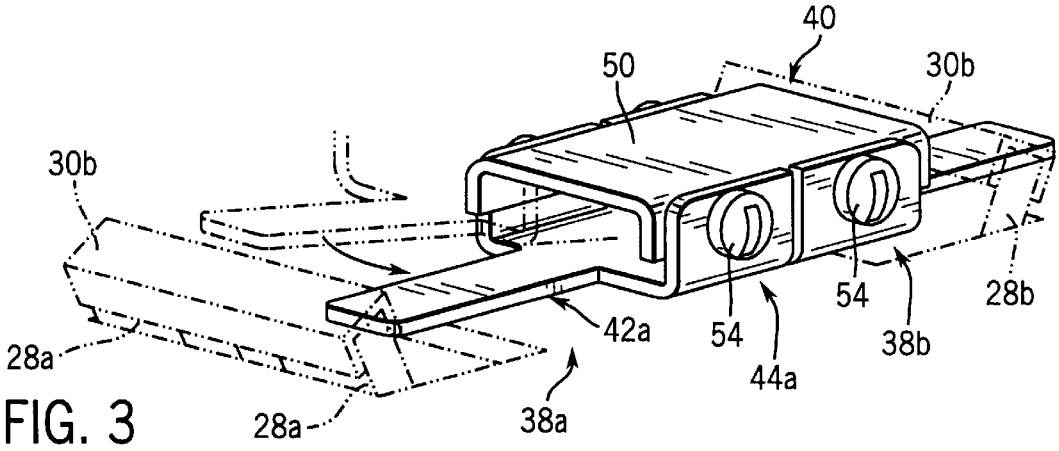
FIG. 3 is an isolated, isometric view of the interlock of FIGS. 1 and 2.

Load center 22 includes a pair of circuit breaker type power supply switches 26*a*, 26*b*, which again are conventionally constructed. In a manner as is known, power supply switches 26*a*, 26*b* may be in the form of a pair of ganged switch assemblies defining a pair of switch members, such as shown in FIG. 3 at 28*a*, 28*b*, with each such pair of switch members being interconnected with a tie bar or cap 30*a*, 30*b*, respectively. Switch members 28*a* and switch members 28*b* are each spaced apart from each other and define facing surfaces, and each cap 30*a*, 30*b* spans between a respective pair of switch members 28*a*, 28*b*, to gang each set of switch members 28*a*, 28*b* together. With caps 30*a*, 30*b* in place, a recess or passage 32*a*, 32*b* is defined by the facing surfaces of each pair of switch members 28*a*, 28*b*, respectively, in combination with a respective one of caps 30*a*, 30*b* and an upwardly facing surface 34*a*, 34*b* defined by switches 26*a*, 26*b*, respectively.

Load center 22 may be equipped with a power input socket 36 (FIG. 2) adapted to receive the end of a power supply cord interconnected with an alternate source of electrical power, such as a generator. Power input socket 36 is interconnected with one of switches 26*a* and 26*b*, and the supply of utility power to load center 22 is interconnected with the other of switches 26*a* and 26*b*. Load center 22 is thus normally supplied with utility power, and can be supplied with an alternate source of power, such as from a generator through power input socket 36, in the event of a failure or interruption of the utility power supply source.

Figure 4:
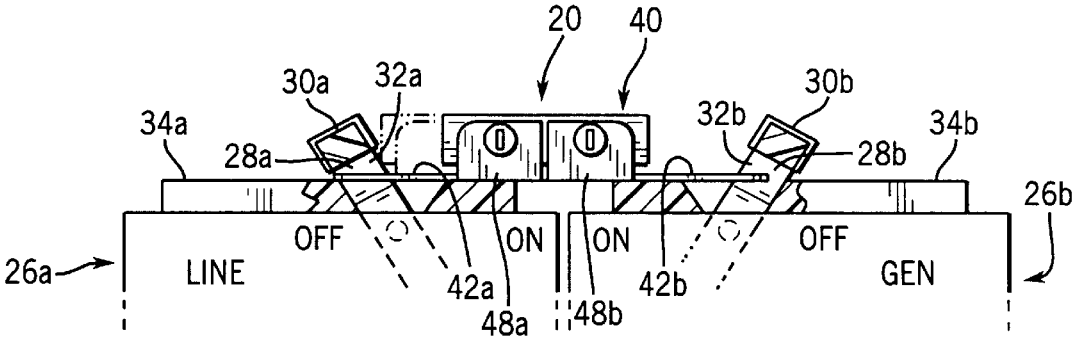
FIG. 4 is a partial sectional view taken along line 4—4 of FIG. 2, showing the interlock between the switches and with the switch operating handles both in the OFF position.

FIG. 4 illustrates switch 26*a* interconnected with the utility power supply source and switch 26*b* interconnected with power input socket 36. Switch members 28*a*, 28*b* of switches 26*a*, 26*b*, respectively, are movable toward each other to an ON position, and are movable away from each other to an OFF position. Interlock 20 is positioned between switch members 28*a*, 28*b* for ensuring that switches 26*a* and 26*b* cannot both be in the ON position at the same time, so as to prevent the simultaneous supply of power to load center 22 from two different sources.

Interlock 20 includes a pair of engagement members 38*a* and 38*b* which are interconnected with each other by a connector member 40. Engagement members 38*a* and 38*b* are identical in construction, and the following description of one is understood to apply equally to the other. Like reference characters will be used for each, with the designations "a" and "b" being used for engagement members 38*a* and 38*b*, respectively.

Figure 3A:
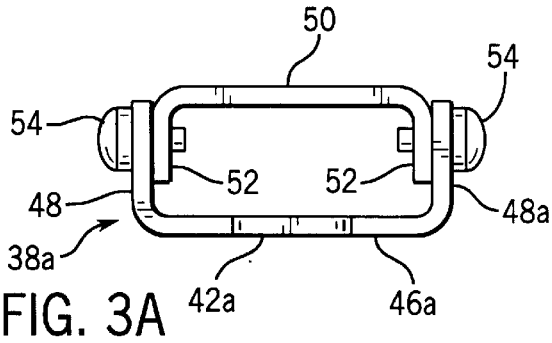
FIG. 3A is an end elevation view of the interlock of FIG. 3.

As shown in FIGS. 3 and 3*a*, engagement member 38*a* includes an outwardly extending flat retainer section 42*a*, which has a width slightly less than that of passage 32*a* as defined by the laterally spaced facing surfaces of switch members 28*a*, such that the edges of retainer section 42*a* are in close proximity to the facing surfaces of switch members 28*a*. The thickness of retainer section 42*a* is less than the height of passage 32*a*, such that retainer section 42*a* is slidably received within passage 32*a*.

An inner U-shaped connection section 44*a* is located at the inner end of retainer section 42*a*, extending inwardly therefrom. Connection section 44*a* includes a flat lower wall 46*a* which is coplanar with retainer section 42*a*, and a pair of spaced tabs 48*a* which extend upwardly from the ends of lower wall 46*a*. Tabs 48*a* are perpendicular to lower wall 46*a* and parallel to each other. Together, tabs 48*a* and lower wall 46*a* define a winged, U-shaped bracket structure which extends outwardly from upwardly facing surface 34*a* of switch 26*a*. A transverse opening 49*a* (FIG. 8) is formed in each tab 48*a*.

Connector member 40 includes an upper wall 50 and a pair of depending side sections or walls 52, which cooperate to form an inverted U-shaped cross-section. Spaced, threaded openings 53 are formed in side walls 52, and are adapted for alignment with openings 49*a*, 49*b* in tabs 48*a*,

48*b*, respectively. Threaded fasteners, such as screws 54, extend through openings 49*a*, 49*b* in tabs 48*a*, 48*b*, respectively, and into engagement with openings 53 in side walls 52, for connecting engagement members or first and second winged brackets 38*a*, 38*b* and connector member 40 together to form a slidable interlock structure disposed between the switch assemblies formed by switch members 28*a*, 28*b* and caps 30*a*, 30*b*, respectively. Side walls 52 are configured so as to overlap tabs 48*a*, 48*b*, and upper wall 50 of connector member 40 is spaced above the plane of retainer members 42*a*, 42*b* and lower walls 46*a*, 46*b* when connector member 40 is engaged with engagement members 38*a*, 38*b* as described, to provide a generally tubular interlock structure as illustrated in FIGS. 3 and 3*a*. Connector or bridge member 40 has a length greater than that of juxtaposed connection sections 44*a*, 44*b*, such that each end of connector member 40 extends outwardly from the adjacent, outwardly facing end of the adjacent tabs 48*a*, 48*b*, respectively. It is understood, however, that connector member 40 may be shorter in length than illustrated and that tabs 48*a*, 48*b* may have a longer length than illustrated, so that the ends of tabs 48*a*, 48*b* extend past the ends of connector member 40, while still providing the same function of interlock 20 as described.

Figure 9:
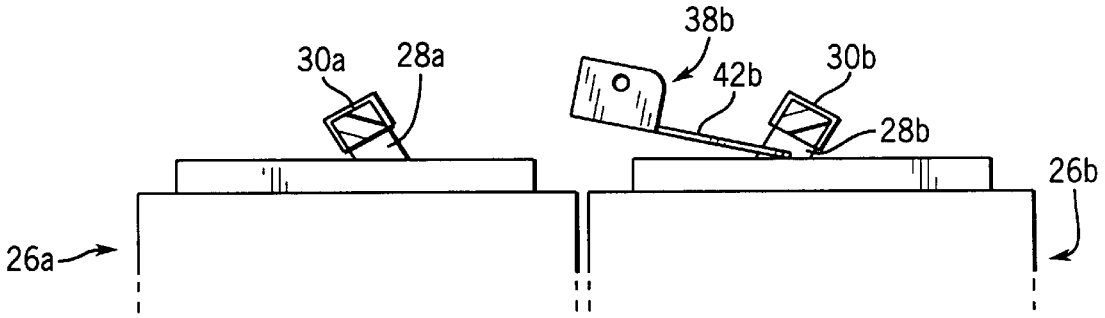
FIGS. 9–11 are views similar to FIGS. 4–6, showing mounting of the interlock to and between the pair of switches.
Figure 10:
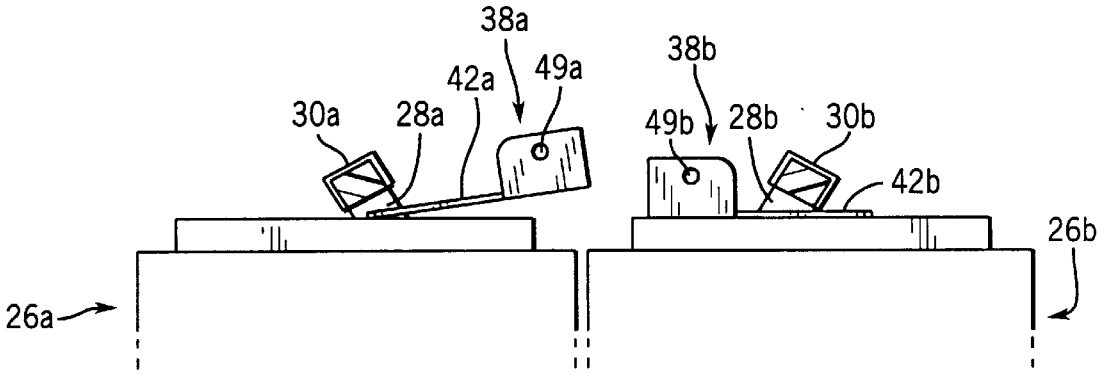
Figure 11:
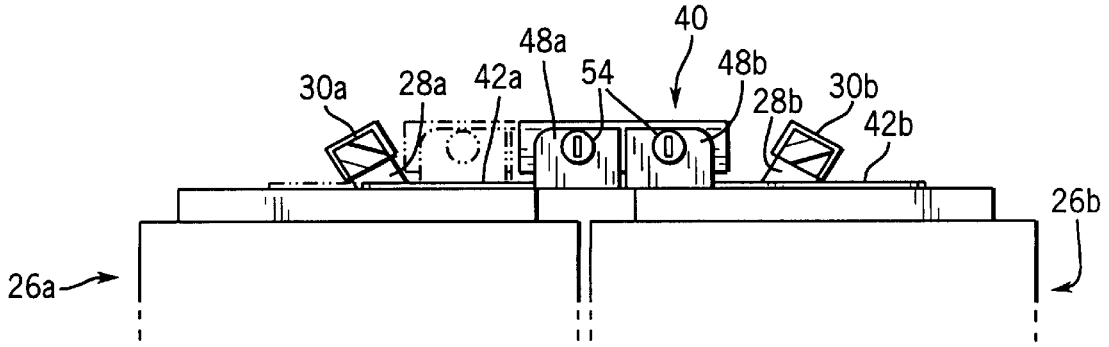

The steps in assembly of interlock 20 are shown in FIGS. 8–11. Initially, one of engagement members 38*a*, 38*b* is engaged with its respective switch 26*a*, 26*b* by inserting retainer section 42 through passage 32. Representatively, engagement member 38*b* is illustrated in FIG. 9 as being inserted into passage 32*b* of switch 26*b*. The lower surface of engagement member 38*b* is then engaged with upwardly facing surface 34*b* of switch 26*b*, as shown in FIG. 10, and engagement member 38*b* is moved outwardly so as to slide retainer section 42*b* through passage 32*b*. The other engagement member, shown at 32*a*, is then engaged with switch 26*a* in a similar manner as shown in FIG. 10. Connection sections 44*a* are then moved toward each other, such that openings 49*a*, 49*b* in tabs 48*a*, 48*b*, respectively, are in alignment with threaded openings 53 in connector member side walls 52. Screws 54 are then employed to secure engagement members 38*a*, 38*b* with connector member 40, to form the assembled interlock as illustrated in FIGS. 3–7 and 11.

When assembled in this manner, interlock 20 is slidably retained between switch members 28*a*, 28*b* by engagement of retainer sections 42*a*, 42*b* within passages 32*a*, 32*b*, respectively. Interlock 20 is thus axially movable in a back and forth manner in the same direction as movement of switch members 28*a*, 28*b* between their ON and OFF positions.

In operation, interlock 20 functions as illustrated in FIGS. 4–7 to prevent both switches 26*a* and 26*b* from being in the ON position at the same time.

Figure 5:
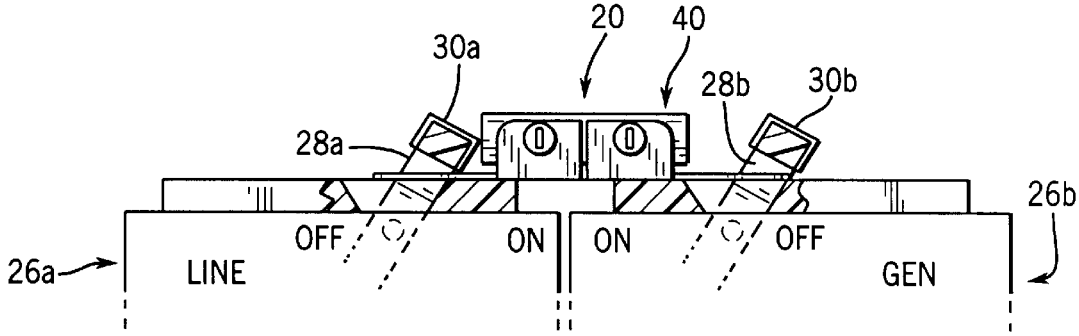
FIG. 5 is a view similar to FIG. 4, showing the interlock and one of the operating handles in the ON position.

When both switch members 28*a* and 28*b* are in the OFF position as illustrated in FIG. 4, interlock 20 remains in position between switch members 28*a* and 28*b* and is retained in place by engagement of retainer sections 42*a*, 42*b* within passages 32*a*, 32*b*, respectively. When utility power is to be supplied to load center 22, switch members 28*a* is moved to its ON position of FIG. 5, and cap 30*a* of switch members 28*a* engages the end of connector member 40 to move interlock 20 rightwardly as shown in FIG. 5 when switch members 28*a* are moved to the ON position. When it is desired to supply generator power to load center 22, or power from any source other than the source controlled by switch 26*a*, switch 26*b* is moved from its OFF position of FIGS. 4 and 5 to its ON position of FIG. 6 by movement of switch members 28*b*. As switch members 28*b* are moved to the ON position, cap 30*b* engages the rightward end of connector member 40 so as to slide interlock 20 leftwardly as shown in FIG. 6, to bring the leftward end of connector member 40 into engagement with cap 30*a*. Continued movement of switch members 28*b* toward its ON position results in sliding lateral leftward movement of interlock 20, which causes movement of switch members 28*a* away from the ON position and toward the OFF position. Switch members 28*a* and 28*b* are spring-biased over-the-center type switches, such that once switch members 28*a* attain a predetermined angular relationship away from the ON position, switch members 28*a* complete travel to the OFF position as shown in FIG. 6 to ensure that switch 26*a* is OFF when switch members 28*b* reach the ON position. Subsequent return of switch members 28*a* toward the ON position results in movement of switch members 28*b* to the OFF position in a similar manner, such that interlock 20 thus prevents both switches 26*a* and 26*b* from being in the ON position at the same time.

It can thus be appreciated that interlock 20 provides a relatively simple interlock structure for preventing aligned switch members from both being in an ON position at the same time, and which is quick and easy to install. Further, the structure of the interlock provided by the interconnected upstanding tabs and the axially extending connector member provides a rigid interlock member which is resistant to bending and which provides positive engagement with the switch members in operation.

Various alternatives and embodiments are contemplated as being within the scope of the following claims particularly pointing out and distinctly claiming the subject matter regarded as the invention.

I claim:

1. An interlock for first and second aligned switches, each of which includes an operating handle defining a passage, wherein each operating handle is movable toward the other to an ON position and movable away from the other to an OFF position, comprising:

a pair of engagement members, each of which includes an outwardly extending retainer section and an upstanding mounting section extending from the retainer section, wherein the outwardly extending retainer section of each mounting member is adapted to be received within the passage of one of the operating handles such that the upstanding mounting section of each engagement member is located between the pair of operating handles; and a connector member extending between and interconnected with the upstanding mounting sections of the mounting members, wherein the interconnected connector member and upstanding mounting sections of the mounting members cooperate to define an axially movable interlock structure located between the operating handles and guided for movement by the retainer sections within the passages defined by the handles, wherein the interlock structure defines an end facing each of the operating handles and is configured so as to prevent the first and second operating handles from both being in the ON position at the same time.

2. The interlock of claim 1, wherein the outwardly extending retainer section of each engagement member is substantially planar and adapted to rest on an outwardly facing surface defined by one of the switches.

3. The interlock of claim 2, wherein the upstanding mounting section of each engagement member comprises a pair of spaced upstanding tab members, each of which lies in a plane substantially perpendicular to the plane of the retainer section and is adapted to extend outwardly relative to the outwardly facing surface of the circuit breaker switch.

4. The interlock of claim 3, wherein the connector member includes an outer wall and a pair of depending side walls, wherein each side wall is adapted for engagement with one of the upstanding tab members of each engagement member.

5. The interlock of claim 4, wherein the connector member and the tab members cooperate to define an interlock structure having a substantially tubular cross-section.

6. The interlock of claim 4, wherein the connector member is engageable with each tab member by means of a threaded fastener extending between and interconnecting each tab member with one of the depending side walls of the connector member.

7. The interlock of claim 2, wherein axial movement of the interlock structure is guided solely by interaction of the planar retainer sections of the engagement members within the passages defined by the handles without guiding engagement of the engagement members with the outwardly facing surface of the switch.

8. An interlock for first and second aligned switches, wherein each switch includes an outer surface and an operating handle extending outwardly from the outer surface, wherein each operating handle includes a pair of laterally spaced facing surfaces adjacent the outer surface of the switch, and wherein each handle is movable toward the other handle to an ON position and away from the other handle to an OFF position, wherein the interlock comprises:

a pair of engagement members, each of which defines an outer retainer section adapted for placement between the laterally spaced facing surfaces of one of the operating handles and against the switch outer surface, and an inner connection section extending upwardly from the retainer section and away from the switch outer surface, wherein the inner connection sections of the pair of engagement members are located adjacent each other between the operating handles and the outer retainer sections extend away from each other; and a connector member extending between and interconnected with the inner connection sections of the pair of engagement members;

wherein the connection sections and the connector member are configured so as to prevent both operating handles from being in the ON position at the same time.

9. The interlock of claim 8, wherein the connection sections and the connector member cooperate to define an upstanding, axially extending interlock structure interposed between the first and second operating handles, wherein each outer retainer section is adapted for sliding axial movement within the space between the facing surfaces of one of the operating handles for providing axial movement of the interlock structure between the operating handles.

10. The interlock of claim 9, wherein the inner connection section of each engagement member comprises a base portion extending along a longitudinal axis substantially perpendicular to a longitudinal axis along which the retainer section extends, and a pair of tab members located one adjacent each end of the base portion and extending upwardly therefrom.

11. The interlock of claim 10, wherein the connector member includes an upper wall and a pair of depending side sections, wherein each side section is adapted for connection to adjacent tab members of the pair of engagement members on one side of the interlock structure.

12. The interlock of claim 11, wherein the tab members and the pair of depending side sections of the connector member define openings which are placed in alignment with each for enabling the depending side sections to be interconnected with the tab members by means of fasteners extending through the aligned openings.

13. An interlock for first and second aligned switches, each of which includes an operating handle defining a passage, wherein each operating handle is movable toward the other handle to an ON position and away from the other handle to an OFF position, comprising:

first and second winged brackets disposed between the operating handles, wherein each winged bracket includes a retainer section engaged with one of the operating handles for providing sliding axial movement of the winged bracket relative to the operating handle; and a bridge member extending between and interconnecting the winged brackets to form an interlock structure movably retained between the operating handles and configured so as to prevent both operating handles from being in the ON position at the same time.

14. The interlock of claim 13, wherein each winged bracket includes a substantially planar base member having first and second spaced tabs extending upwardly therefrom.

15. The interlock of claim 14, wherein each base member includes an axially extending outer section adapted to extend through a recess associated with one of the operating handles, and an inner section extending transversely relative to a longitudinal axis defined by the outer section, wherein the spaced tabs are formed on the inner section.

16. The interlock of claim 15, wherein the bridge member defines a pair of spaced side sections, wherein each tab of one of the winged brackets is located adjacent one of the tabs of the other winged bracket, and wherein each side section of the bridge member is adapted for connection to and between a pair of the adjacently located tab members.

17. The interlock of claim 16, wherein the bridge member includes an outer wall from which each side section extends, wherein the outer wall is spaced from the planar base members of the winged brackets when the side sections are interconnected with the tabs, to provide a generally tubular interlock structure located between the operating handles.

18. A method of preventing aligned operating handles of a pair of switches from being in an ON position at the same time, wherein each switch defines an outer surface and wherein each operating handle includes passage structure located adjacent the outer surface, wherein each operating handle is movable toward the other to the ON position and away from the other to an OFF position, comprising the steps of:

engaging an engagement member with each operating handle such that an axial retainer section defined by each engagement member is received within the operating handle passage structure, and a connection section defined by each engagement member is located between the operating handles, wherein each connection section extends outwardly away from the switch outer surface; and interconnecting the engagement members together by securing the connection sections together between the operating handles, wherein the interconnected engagement members are axially movable relative to the operating handles and the connection sections are configured so as to prevent both operating handles from being in the ON position at the same time.

19. The method of claim 18, wherein the step of engaging the engagement member with each operating handle is carried out without providing axial guiding engagement of the engagement member with the outer surface of the switch.

20. The method of claim 19, wherein the step of interconnecting the engagement members together is carried out utilizing a connector member which spans between and is interconnected with the connection sections of the engagement members, wherein the connector member includes an outer wall spaced from a planar base section defined by each engagement member, wherein the connection section of each engagement member includes a pair of tab members extending from the planar base section with which the outer wall of the connector member is interconnected, wherein the connector member and the connection sections cooperate to define an axially movable interlock structure retained between the operating handles by the retainer sections of the engagement members.

* * * * *